United States Patent [19]

Scott

[11] 4,169,503

[45] Oct. 2, 1979

[54] APPARATUS FOR GENERATING A SHOCK WAVE IN A WELL HOLE

[75] Inventor: Harold W. Scott, Ridgefield, Conn.

[73] Assignee: Oil Recovery Corporation, Ridgefield, Conn.

[21] Appl. No.: 863,434

[22] Filed: Dec. 22, 1977

Related U.S. Application Data

[62] Division of Ser. No. 502,661, Sep. 3, 1974, Pat. No. 4,074,758.

[51] Int. Cl.[2] ..... E21B 43/25

[52] U.S. Cl. ..... 166/65 R; 166/65 M; 166/177; 166/249; 166/271

[58] Field of Search ..... 166/249, 248, 177, 65 R, 166/65 M, 64, 297; 175/16, 4.51; 299/14; 313/232

[56] References Cited

U.S. PATENT DOCUMENTS

| | | | |
|---|---|---|---|
| 2,670,801 | 3/1954 | Sherborne | 166/249 |
| 2,871,943 | 2/1959 | Bodine, Jr. | 166/249 |
| 3,100,443 | 8/1963 | Pohoriles | 175/4.51 |
| 3,169,577 | 2/1965 | Sarapuu | 166/248 |
| 3,180,418 | 4/1965 | MacLeod | 166/177 X |
| 3,422,894 | 1/1969 | Brandon | 166/249 |
| 3,500,942 | 3/1970 | Smith | 175/16 |
| 3,621,916 | 11/1971 | Smith, Jr. | 166/297 |
| 3,718,186 | 2/1973 | Brandon | 166/307 X |
| 4,074,758 | 2/1978 | Scott | 166/177 |

*Primary Examiner*—Stephen J. Novosad

[57] ABSTRACT

A method and apparatus are provided for recovering oil from an oil bearing soil by means of an electrohydraulic shock wave generated in a liquid by capacitor electrical discharge means.

1 Claim, 6 Drawing Figures

FIG. 1
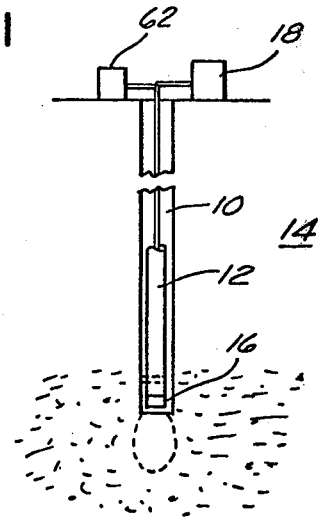
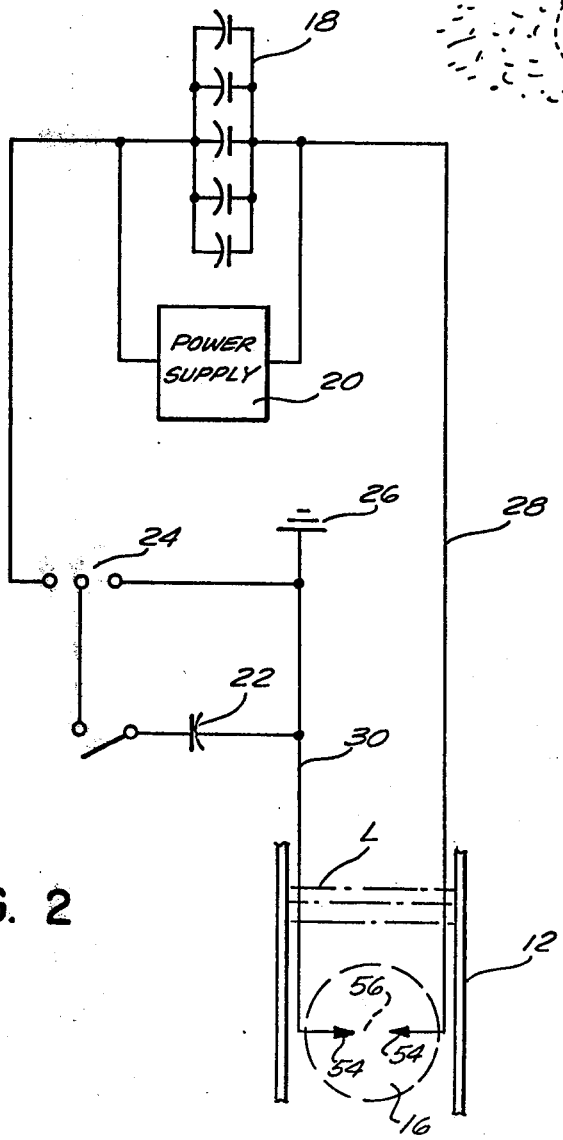
FIG. 2

FIG. 4
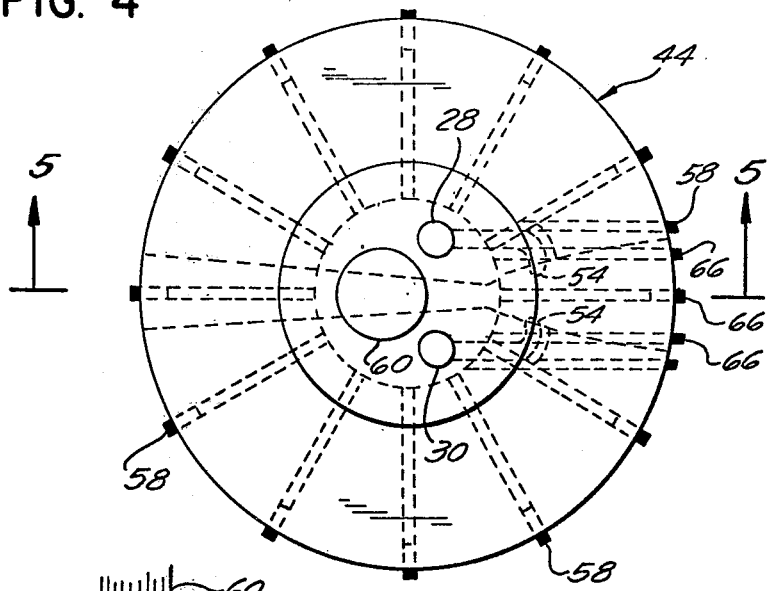
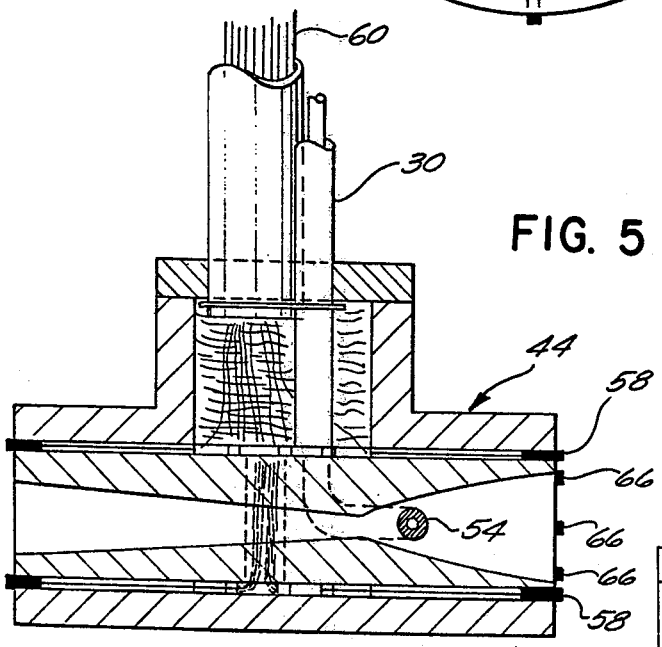
FIG. 5
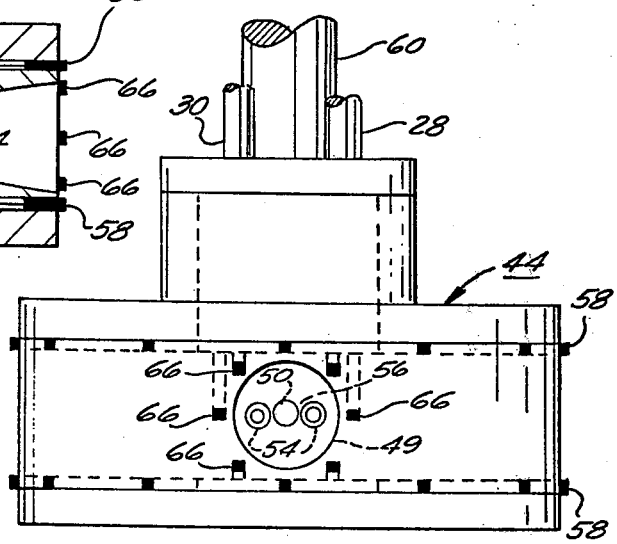
FIG. 6

APPARATUS FOR GENERATING A SHOCK WAVE IN A WELL HOLE

This is a division of application Ser. No. 502,661 filed Sept. 3, 1974, now U.S. Pat. No. 4,074,758 issued Feb. 21, 1978.

BACKGROUND OF THE INVENTION

This invention relates to an apparatus and method for recovering oil from an oil bearing soil by means of the generation of a shock wave in a liquid in the bearing soil.

As used in this specification, the term "oil" means natural oil or petroleum as found in nature particularly in oil bearing soils. Such a product is often called "crude oil" which consists principally of hydrocarbons.

The removal of oil by the use of drilled oil wells in the oil bearing soil has been practiced for several generations. Many of the wells have ceased to be utilized because it is not economical to remove the oil which remains in the soil by conventional methods. To remove the oil which is left behind in a reservoir, such oil being called "residual oil", it has been suggested to use various techniques. The primary technique is to flood the well with water in order to induce further flow. In addition to water flooding, other techniques have been developed such as the injection of liquified petroleum gas, solvents, or surfactants into the well, usually before the water flooding occurs.

In addition, it has been suggested to use a thermal explosion at the bottom of the well, hopefully to cause additional fissures in the oil bearing soil so as to increase the oil flow. Obviously, thermal explosions have the disadvantage of destroying the well and, also, of having a limited effect if they are to be kept from destroying the well.

Accordingly, it is an object of the present invention to provide a method and apparatus for recovering oil from an oil bearing soil by increasing the oil flow with a minimum of damage to the oil well.

It is a further object of the present invention to provide a method and apparatus which can be easily and efficiently placed in the well with a minimum of shut down time of well operations.

It is another object of the present invention to provide recovery method which is economical in operation as well as requiring a minimum amount of fixed equipment.

SUMMARY OF THE INVENTION

By the present invention a method and apparatus are provided for recovering oil from an oil bearing soil by means of an electrohydraulic shock wave generated in a liquid in the well. The shock wave is achieved by means of capacitor electrical discharge means. By the present method and apparatus liquid in the well either in the form of water or oil forms and transmits the shock wave which moves through the liquid until it meets an interface with another material which will usually be rock or densely packed soil. At the point of interface, the shock wave will then reduce the tension which exists between the oil contained in the rock or soil and increase its flow into the well area. In addition, the shock wave will cause further fissures in the surrounding area providing further channels for flow of oil released from the bearing soil. In cases where the shock wave is utilized in combination with a water flood the increased fissures will permit further areas for the water flood to fill and thus improve the oil flow.

The apparatus of the present invention primarily consists of capacitor electrical discharge means which is connected to a power source and to a shock wave generator. The shock wave generator includes a pair of discharge electrodes forming a spark gap preferably placed within a shock tube which will direct the shock wave outwardly from the well into the soil.

DESCRIPTION OF THE DRAWINGS

FIG. 1 is a diagrammatic view of a well with the apparatus for carrying out the present invention in position therein;

FIG. 2 is a diagrammatic view of the apparatus for carrying out the present invention;

FIG. 4 is a plan view of the firing head of the apparatus of the present invention;

FIG. 5 is a sectional view of the firing head along lines 5—5 of the present invention; and FIG. 6 is a side view of the firing head of the present invention.

DESCRIPTION OF THE ILLUSTRATED EMBODIMENT

Figure 3:
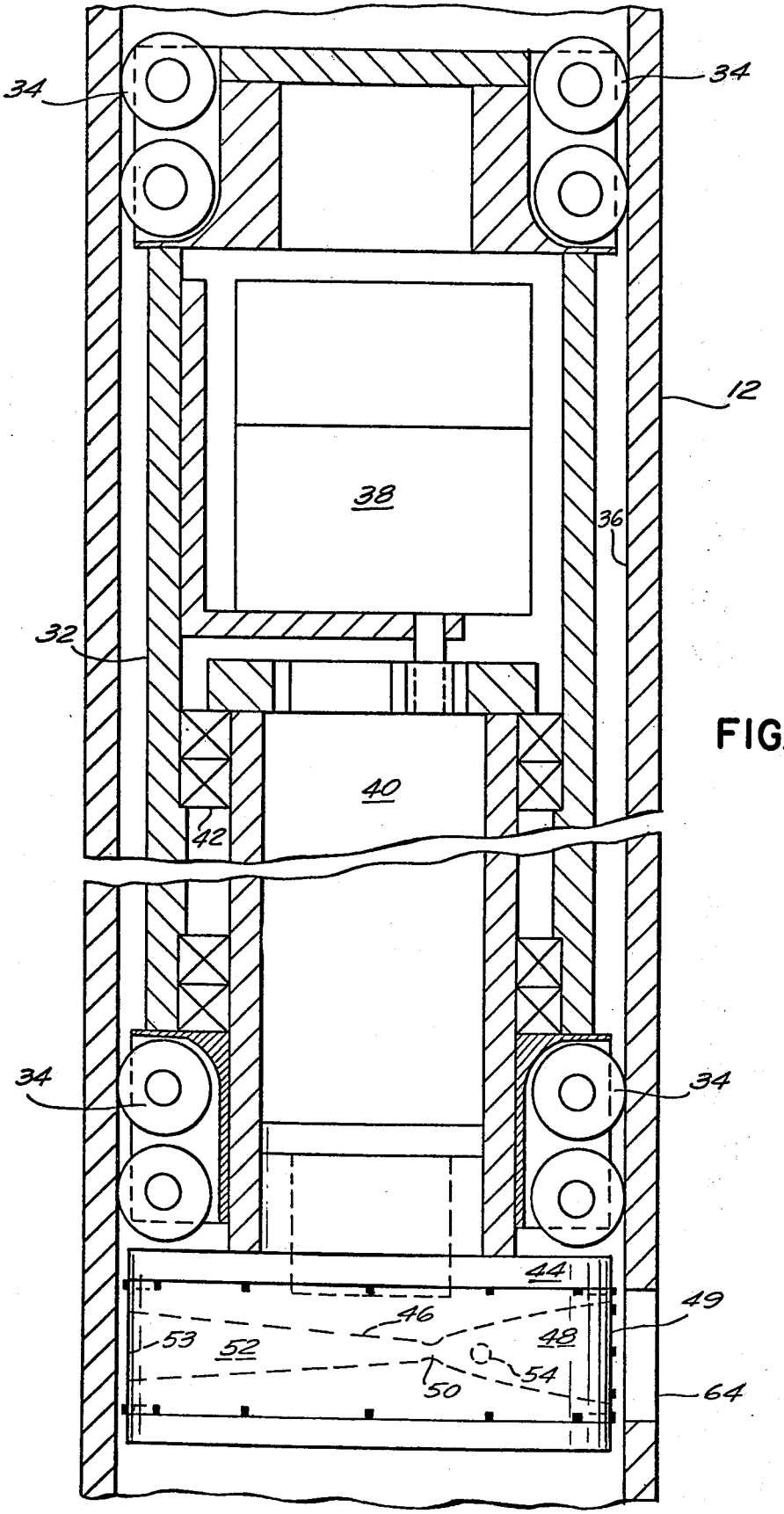
FIG. 3 is an enlarged partially sectional side view of the apparatus of the present invention positioned within a well casing.

Referring to the drawings and to FIG. 1 in particular, a well hole 10 with a well casing 12 therein is placed in an oil bearing soil 14. This is the usual combination which is found in any oil well drilling and pumping operation. Positioned at the lower end of the well casing is a shock wave generator 16. This generator, in turn, is connected to an energy storage capacitor bank 18.

Referring to FIG. 2 the diagrammatic operation of the shock wave generator and capacitor bank will provide an understanding of the apparatus and method of the present invention. An electrical power supply 20 is connected to a main energy storage capacitor bank 18 which, in turn, is connected to a trigger switch 22 and a main three electrode switch 24. Since the system will use direct current voltage, the unit is also connected to a ground 26. The shock wave generator 16 is connected to the energy storage capacitor bank 18 by means of leads 28 and 30. Lead 30 is connected to the capacitor bank 18 through the trigger switch 22 and the main switch 24.

In actual operation the power supply is connected to the energy storage capacitor bank until the bank has been sufficiently charged. At that point the operator closes the trigger switch 22. This, in turn, causes the main three electrode switch 24 to arc over releasing the energy stored in the capacitor bank to the shock wave generator. Since the shock wave generator is placed within the casing 12 and a liquid L is within the casing, the shock wave generated by the generator will be imparted to the liquid L causing an electrohydraulic shock wave. The discharge from the capacitor bank 18 lasts but a few millionths of a second and the resulting shock wave is a severe one. Shock waves caused in this manner are known in other arts such as in metal forming wherein a shock wave so generated has been sufficient to die form a metal plate by the generated force.

The shock wave generator is shown in greater detail in FIGS. 3 through 6.

The generator includes a support frame 32 to which is fitted rollers 34 which act to guide the generator which is moved within the well casing 12 along its inner wall surface 36.

The shock wave generator is positioned at the desired elevation within the well casing by any suitable means. It might be placed on the end of a smaller diameter casing and ran within the existing casing or, if desired, it could be lowered by means of cable. Mounted on the frame 32 is a drive motor 38 which is connected to a rotator 40. The drive motor 38 is of the electrical type and may be energized and driven by lead connections to the surface. Bearings 42 are provided to permit the rotator to move within the generator frame 32. The rotator is connected to a firing head 44. The firing head 44 is of suitable shock resistant material such as brass. Fitted within the head 44 is a shock tube 46. The shock tube 46 consists of a firing chamber 48 preferably having a parabolic curve configuration with wide mouth flared opening 49. The chamber 48 is connected to a throat portion 50 which has a substantially reduced cross sectional area with respect to the opening 49. The throat in turn is connected to a relief chamber 52 which has an opening 53 therein, the opening 53 being of greater cross sectional area than the throat 50 but of lesser cross sectional area than the firing chamber opening 49. Set within the firing chamber 48 is a pair of discharge electrodes 54 which are connected to the leads 28 and 30. Between the discharge electrodes 54 is a space 56 which forms the spark gap of the apparatus.

The shock wave generator in order to function properly must be positioned at the proper desired elevation in the well casing. The elevational positioning of the firing head is obtained by means of magnetic sensors or detectors 58 which are spaced about the head and will react to the metal casing and by means of detector leads 60 connected to a detector control panel determine whether or not the head is positioned approximately at the elevation of a well casing opening 64. This is accomplished by noting at the detector control panel 62 whether or not the rows of sensors 58 are making metal contact. When at least some of the sensors indicate no contact then the head is at the approximate elevation of a well casing opening 64. Also, the means of lowering the generator 16, can be marked to show the approximate depth of insertion into the casing. With the head 44 of the generator 16 at the approximate desired level, the head can then be rotated by means of rotator 40 until the lateral magnetic sensors 66 indicate no metal contact. At that point the firing chamber opening 49 is properly centered on a well casing opening 64 as shown in FIG. 3. To insure proper direction of the shock wave from the chamber 48, and clearance of the well casing 12, the firing chamber opening 49 is preferably of lesser diameter than the casing opening 64. For example with a one inch casing hole the chamber opening would be about three quarters of an inch and spaced about one eighth of an inch from the inner surface 36 of the well casing.

By forming the firing chamber in a paraboloid of similar horn shape the shock wave of the discharge occurring within the chamber 48 can be directed to clear the casing opening and will function as a shaped charge.

By use of the rotator 40 the firing head 44 can be positioned as desired to fire through any opening in the casing 12. Also since the capacitor bank is readily recharged a series of shock waves may be generated for sequential firing through the same opening.

While the present method and apparatus have been described with the illustrated embodiment as firing through a well casing opening, it is to be understood that if desired the firing head may be positioned below the well casing and fired at that level. Also, it is well within the scope of the present invention to incline the firing head with respect to a horizontal plane and, thus, fire upwardly or downwardly into the surrounding oil bearing soil.

The term soil as used herein is meant to include all oil bearing strata, either solid or particulate.

What is claimed:

1. Apparatus for generating an electrohydraulic shock wave from a metallic well pipe in a liquid in a well hole in an oil bearing soil comprising:

capacitor electrical discharge means;

a shock wave generator including a pair of adjacent and opposed discharge electrodes forming a spark gap and connected to said capacitor electrical discharge means;

means for positioning the spark gap at a selected location in the well hole, said means including magnetic sensors for positioning the spark gap at an opening in the pipe; and means for directing a shock wave in the liquid from the well hole and into the soil when an electrical discharge occurs between the electrodes.

* * * * *